US006416009B1

(12) United States Patent
Iaciofano et al.

(10) Patent No.: US 6,416,009 B1
(45) Date of Patent: Jul. 9, 2002

(54) RETRACTABLE HOSE REEL ASSEMBLIES WITH LOCKING MECHANISMS FOR PREVENTING WINDING AND/OR UNWINDING

(75) Inventors: Nicolino Iaciofano, High Wycombe; Michael Lars George Hill, Steeple Claydon, both of (GB)

(73) Assignee: Hozelock Limited, Aylesbury (GB)

( * ) Notice: Subject to any disclaimer, the term of this patent is extended or adjusted under 35 U.S.C. 154(b) by 0 days.

(21) Appl. No.: 09/340,752

(22) Filed: Jun. 28, 1999

(30) Foreign Application Priority Data

Jul. 3, 1998 (GB) ..... 9814439

(51) Int. Cl.[7] ..... B60R 22/34
(52) U.S. Cl. ..... 242/384.7; 242/385.4
(58) Field of Search ..... 242/384.7, 385.4, 242/396.4

(56) References Cited

U.S. PATENT DOCUMENTS

| | | | | | |
|---|---|---|---|---|---|
| 737,769 | A | * | 9/1903 | Preston | 242/384.7 |
| 967,601 | A | * | 8/1910 | Bovard | 242/396.4 |
| 993,409 | A | * | 5/1911 | Roderick | 242/384.7 |
| 1,163,444 | A | * | 12/1915 | Newell | 242/384.7 |
| 2,249,114 | A | * | 7/1941 | Coffman | 242/385.4 |
| 2,659,573 | A | * | 11/1953 | Smith, Sr. | 242/384.7 |
| 2,775,035 | A | * | 7/1956 | Moulder | 242/396.4 |
| 3,550,875 | A | * | 12/1970 | Setimi | 242/385.4 |
| 3,693,596 | A | * | 9/1972 | Croce et al. | 242/385.4 |
| 3,853,283 | A | * | 12/1974 | Croce et al. | 242/385.4 |
| 3,937,418 | A | * | 2/1976 | Critelli | 242/384.7 |
| 4,187,962 | A | * | 2/1980 | Henry | 242/385.4 |
| 4,784,221 | A | * | 11/1988 | Share et al. | 242/396.4 |
| 4,856,726 | A | * | 8/1989 | Kang | 242/384.7 |
| 5,245,761 | A | * | 9/1993 | Waldherr | 242/384.7 |
| 5,377,626 | A | * | 1/1995 | Kilsby et al. | 242/384.7 |
| 5,400,521 | A | * | 3/1995 | Waldherr | 242/385.4 |
| 5,829,154 | A | * | 11/1998 | Lin | 242/384.7 |
| 6,082,656 | A | * | 7/2000 | Thornton | 242/385.4 |

* cited by examiner

*Primary Examiner*—Emmanuel M. Marcelo
(74) *Attorney, Agent, or Firm*—Lee, Mann, Smith, McWilliams, Sweeney & Ohlson

(57) ABSTRACT

A retractable hose reel assembly comprises a reel (2) rotatably mounted in a casing (1) and a torsion spring (8) for rotating the reel in a direction corresponding to winding of the hose on the reel (2). A ratchet (14) and pawl (18) prevent or limit rotational movement of the reel (2) in the winding direction. A lever (20) is manually movable to a locking position in which unwinding movement of the reel (2) is prevented, for example to prevent vandalism or to prevent a child pulling the hose from the reel and suffering discomfort or injury as a result of retraction of the hose by the spring (8).

7 Claims, 3 Drawing Sheets

RETRACTABLE HOSE REEL ASSEMBLIES WITH LOCKING MECHANISMS FOR PREVENTING WINDING AND/OR UNWINDING

This invention relates to retractable hose reel assemblies.

A known hose reel assembly comprises a casing providing a rotatable support for a reel around which the hose is wound. When the hose is pulled off the reel, a spring is wound up to provide stored energy which is used for driving the reel in a direction corresponding to winding of the hose, to provide for automatic retraction of the hose onto the reel. The invention aims to provide a means of preventing withdrawal or unwinding movement of the hose from the reel, for example to prevent vandalism or to prevent a child pulling the hose from the reel and then possibly suffering discomfort or injury as a result of the automatic retraction of the hose.

According to one aspect of the invention a retractable hose reel assembly comprises a casing, a reel rotatably mounted with respect to the casing and locking means for preventing or limiting rotational movement of the reel in a direction corresponding to unwinding of the hose from the reel.

According to another aspect of the invention a retractable hose reel assembly comprises a casing, a reel rotatably mounted in the casing, drive means for rotating the reel in a direction corresponding to the winding of the hose on the reel, first retaining means for preventing or limiting rotational movement of the reel in a winding direction and second retaining means for preventing or limiting rotational movement of the reel in an unwinding direction. Preferably, the second retaining means are capable of being rendered operative at a partially unwound condition of the hose or at the fully wound condition of the hose.

The second retaining means preferably include an actuating member manually movable between an operative locking position, in which the second retaining means prevent or limit unwinding movement of the reel, and an inoperative unlocked position in which the second retaining means are inoperative. The actuating member is preferably a pivotally movable lever incorporating or carrying a projecting end in the form of a crank, which, in the operative position, projects into the path of movement of the rotatable reel or a member carried thereby, in order to block rotation of the reel in an unwinding direction.

The first retaining means may comprise a ratchet and pawl, one mounted on the casing and the other on the reel, with the ratchet preferably being mounted on the reel and the pawl on the casing. The drive means may include a torsion spring in which energy is stored when the hose is unwound from the reel.

In the preferred embodiment to be described, the ratchet is mounted on the reel and carries projecting formations with which the crank is engageable in order to prevent or limit rotational movement of the reel in an unwinding direction.

A retractable hose reel assembly according to the invention will now be described, by way of example, with reference to the accompanying drawings, in which.

Figure 1:
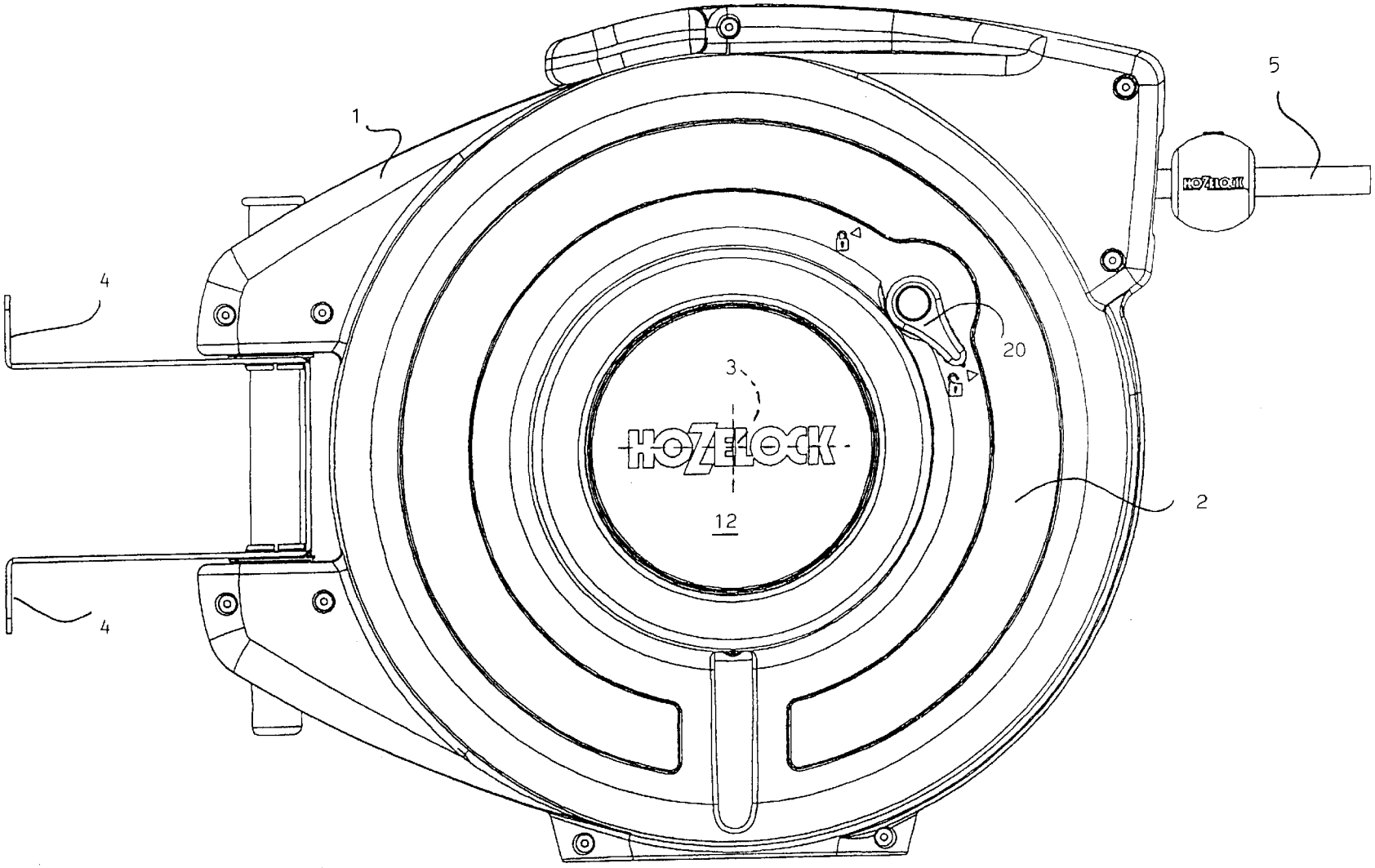
FIG. 1 is a front elevation of the hose reel assembly.

The hose reel assembly comprises an outer casing 1 which supports a hose reel 2 capable of rotational movement with respect to the outer casing 1 about a horizontal axis indicated in end view at 3 in FIG. 1. Mounting brackets 4 rigidly attached to the casing 1 enable the hose reel assembly to be mounted on a wall. A hose pipe, a projecting portion of which is indicated at 5 in FIG. 1, is wound around a cylindrical hub of the reel 2, the hose pipe passing between spaced guides 7 in its passage on and off the reel 2. As the hose pipe is pulled off the reel, a torsion spring 8 is wound up, being driven by a toothed belt 9 passing around a smaller sprocket 10 mounted on the end of the torsion spring drive shaft and a larger sprocket (not shown) rotatable with the reel 2. The energy stored in the spring 8 is used to drive the reel, in an anti-clockwise direction when the reel assembly is viewed from the front as in the drawings, to rewind the hose on the reel 2. To store the complete length of hose on the reel 2 requires about twenty rotations of the reel 2.

On the front side of the assembly, the reel has a central disc-like cover 12 which is removable to reveal a connector 13 for attaching a pipe for supplying water to the hose on the reel. From the connector 13 water passes through a rotatable O-ring seal to the inner end of the hose pipe on the reel. After connection of the supply pipe to the connector 13, the cover 12 is replaced.

Attached to the reel 2 and rotatable therewith is a ratchet 14 which is of arcuate shape, subtending an angle of 135° at the rotational axis 3. The radially outer edge of the ratchet 14 has four equi-angularly spaced recesses 15 defining five projecting teeth, the end teeth having sloping ramp-like surfaces 16 at respective ends of the ratchet 14. The ratchet 14 is engaged by the projecting finger 17 of a pawl 18 mounted on the outer casing 1 for rotation about a horizontal axis parallel with the axis 3. The pawl 18 is urged by a spring in a rotatable direction which is clockwise when viewed from the front of the hose reel assembly.

Figure 2:
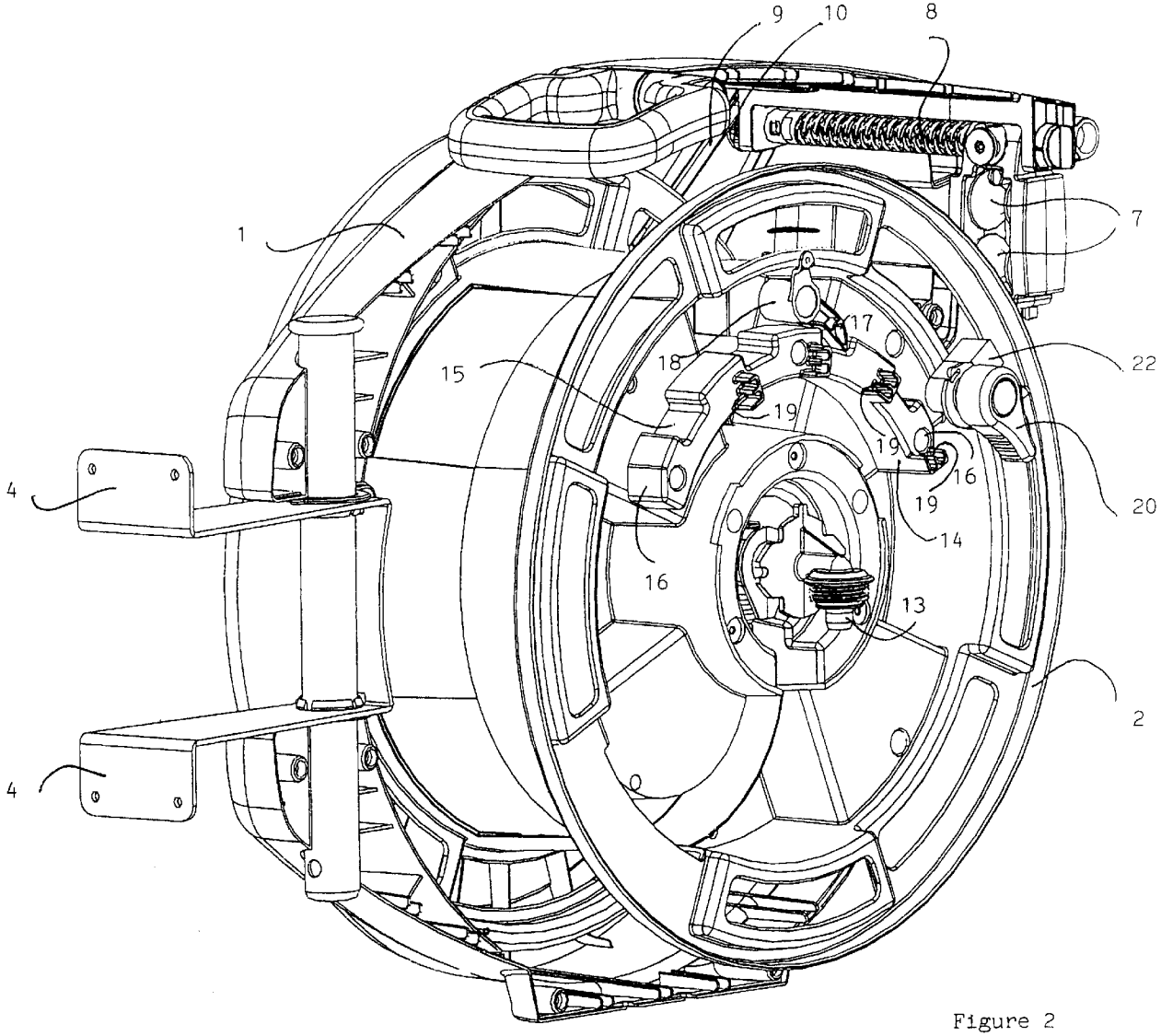
FIG. 2 is an isometric view of the assembly with a front part of the casing cut away to show internal detail and with a locking lever in an inoperative position.
Figure 3:
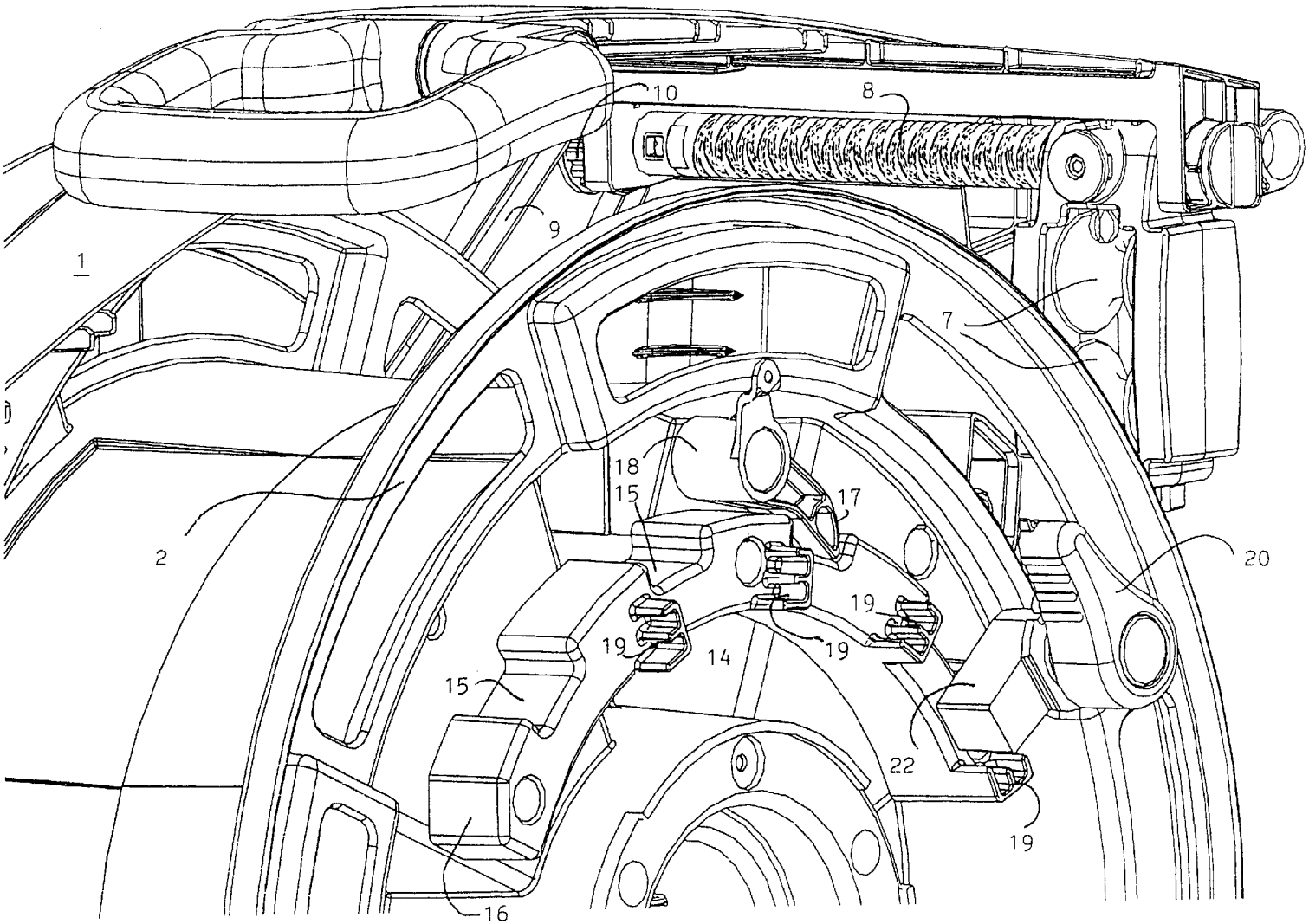
FIG. 3 is a fragmentary view, to an enlarged scale, of part of FIG. 2 but with the locking lever in an operative position.

It will be appreciated that the inter-engagement of the pawl 18 in one of the recesses 15 of the ratchet 14 (as shown in FIGS. 2 and 3) acts to prevent the reel rotating in an anti-clockwise direction, corresponding to the hose being wound onto the reel. If the hose pipe is pulled off the reel, the pawl rides over the ratchet teeth with an audible clicking sound until the pawl clears the ratchet, after which the hose pipe may be released. The pawl 18, being deflected by the leading ramp-like surface 16, then rides over the ratchet 14 as the spring 8 drives the reel 2 in an anti-clockwise direction to wind the pipe onto the reel 2.

In addition to the retaining means constituted by the inter-engagement of the pawl 18 in the ratchet recesses 15, the hose reel has further retaining means which can be engaged to prevent the hose pipe being pulled off the reel 2, either from a fully wound condition or any partially wound condition. The further retaining means comprise four spaced lugs 19 projecting from the front face of the ratchet 14 and a manually rotatable lever 20 mounted on the front of the casing so as to be pivotable between an operative locking position shown in FIGS. 1 and 3 and an inoperative unlocked position shown in FIG. 2. The lever 20 is attached to a projection forming a crank 22. When the lever 20 is in the locking position, the crank 22 occupies a position in which it projects radially inwardly from the pivot axis of the lever and into the path of movement of the lugs 19. When the lever 20 is in the unlocked position (FIG. 2) the crank 22 projects radially outwardly from the pivot axis of the lever and is thus clear of the lugs 19.

It will be appreciated that the pawl 18 and ratchet 14 must be engaged for the lock provided by the crank 22 to be effective. Commencing with the lever 20 in the unlocked position, the user pulls the hose pipe off the reel 2. When the ratchet 14 engages the pawl 18 a clicking sound is heard and if the pull on the hose is then slackened the bias applied to the reel 2 by the spring 8 causes the pawl 18 to engage in one of the ratchet recesses 15. With the ratchet and pawl thus engaged, the lever 20 can be rotated through 180° from its unlocked position to its locked position, so bringing the crank 22 into a position where it is adjacent a corresponding one of the lugs 19. If an attempt is now made to pull the hose pipe from the reel 2, the adjacent lug 19 engages the crank 22 to prevent clockwise rotation of the reel in an unwinding direction. Any tensile force applied to the hose pipe is transferred through the lug 19 and the crank 22 to the outer casing 1 which is a ribbed structure able to withstand such forces. In this condition, the interengagement of the ratchet and pawl prevent winding rotation of the reel and the crank 22 blocks unwinding rotation of the reel. This doubly locked condition can prevail with the pawl in any one of the four recesses 15 in the ratchet.

Rotation of the lever 20 through 180° to its unlocking position frees the reel for unwinding rotation. The reel 2 is prevented from rotating in a winding direction until the hose pipe is pulled out a sufficient distance for four clicks to be heard, corresponding to the ratchet clearing the pawl. If the reel 2 is rotating in the winding direction under the influence of the spring 8, any attempt to move the lever 20 to the locking position will cause the crank 22 to be struck by one of the lugs 19, to return the lever 20 to the unlocking position. This protects the locking mechanism from the extreme load to which it would be subjected if rotation of the reel 2 was suddenly blocked by a crank 22.

Thus the lever 20 can be rotated to lock the reel against unwinding movement, to provide a child lock or general purpose safety lock.

The casing 1, reel 2 ratchet 14 with integrally formed lugs 19, pawl 18, lever 20 and crank 22 are moulded from a synthetic plastics material.

What is claimed is:

1. A retractable hose reel assembly comprising a casing, a reel rotatably mounted in the casing, drive means for rotating the reel in a direction corresponding to winding of the hose on the reel, first retaining means for preventing or limiting rotational movement of the reel in a winding direction and second retaining means for preventing or limiting rotational movement of the reel in an unwinding direction, wherein the second retaining means include an actuating member manually movable between an operative locking position, in which the second retaining means prevent or limit unwinding movement of the reel, and an inoperative unlocked position in which the second retaining means are inoperative, and wherein the actuating member is a pivotally movable lever incorporating or carrying a projecting end in the form of a crank, which, in the operative position, projects into the path of movement of the rotatable reel or a member carried thereby, in order to block rotation of the reel in an unwinding direction.

2. A hose reel assembly according to claim 1, wherein the second retaining means are capable of being rendered operative at a partially unwound condition of the hose or at the fully wound condition of the hose.

3. A hose reel assembly according to claim 1, wherein the first retaining means comprise a ratchet and pawl, one mounted on the casing and the other on the reel.

4. A hose reel assembly according to claim 3, wherein the ratchet is mounted on the reel and the pawl on the casing.

5. A hose reel assembly according to claim 4, wherein the ratchet carries projecting formations with which the crank is engageable in order to prevent or limit rotational movement of the reel in an unwinding direction.

6. A retractable hose reel assembly comprising a casing, a reel rotatably mounted in the casing, drive means for rotating the reel in a direction corresponding to winding of the hose on the reel, first retaining means for preventing or limiting rotational movement of the reel in a winding direction and second retaining means for preventing or limiting rotational movement of the reel in an unwinding direction, wherein the second retaining means include an actuating member manually movable between an operative locking position, in which the second retaining means prevent or limit unwinding movement of the reel, and an inoperative unlocked position in which the second retaining means are inoperative, and wherein the first retaining means is operable independently of the actuating member, thereby to enable the first retaining means to prevent the drive means from transmitting force to the actuating member, for at least one angular position of the reel, during movement of the actuating member between its operative and inoperative positions.

7. A retractable hose reel assembly comprising a casing, a reel rotatably mounted in the casing, drive means for rotating the reel in a direction corresponding to winding of the hose on the reel, first retaining means for preventing or limiting rotational movement of the reel in a winding direction and second retaining means for preventing or limiting rotational movement of the reel in an unwinding direction, wherein the second retaining means include an actuating member manually movable between an operative locking position, in which the second retaining means prevent or limit unwinding movement of the reel, and an inoperative unlocked position in which the second retaining means are inoperative, wherein the actuating member is a pivotally movable lever incorporating or carrying a projecting end in the form of a crank, which, in the operative position, projects into the path of movement of the rotatable reel or a member carried thereby, in order to block rotation of the reel in an unwinding direction, and wherein the direction of allowable pivotal movement of the crank and lever is such that movement of the reel in the winding direction can cause the reel or said member carried thereby to move the crank and hence the lever into the inoperative position.

* * * * *